US008011909B2

(12) United States Patent
Dong

(10) Patent No.: US 8,011,909 B2
(45) Date of Patent: Sep. 6, 2011

(54) BALANCED VARIABLE DISPLACEMENT VANE PUMP WITH FLOATING FACE SEALS AND BIASED VANE SEALS

(75) Inventor: Xingen Dong, Farmington, CT (US)

(73) Assignee: Goodrich Pump & Engine Control Systems, Inc.

( * ) Notice: Subject to any disclaimer, the term of this patent is extended or adjusted under 35 U.S.C. 154(b) by 651 days.

(21) Appl. No.: 12/077,663

(22) Filed: Mar. 20, 2008

(65) Prior Publication Data

US 2008/0240935 A1 Oct. 2, 2008

Related U.S. Application Data

(60) Provisional application No. 60/920,477, filed on Mar. 28, 2007.

(51) Int. Cl.
*F01C 19/00* (2006.01)
*F03C 2/00* (2006.01)
*F03C 4/00* (2006.01)

(52) U.S. Cl. ..... 418/136; 418/133; 418/146; 418/148; 418/259; 418/268

(58) Field of Classification Search ..... 418/133, 418/136, 145, 146, 148, 259, 260, 266–268
See application file for complete search history.

(56) References Cited

U.S. PATENT DOCUMENTS 3,547,562 A 12/1970 Cynor
3,784,326 A 1/1974 Lagana et al.
3,924,970 A 12/1975 Johnston et al.
4,272,227 A 6/1981 Woodruff
4,445,830 A 5/1984 Woodruff
4,551,080 A * 11/1985 Geiger ..... 418/267
4,692,104 A * 9/1987 Hansen ..... 418/146
(Continued)

FOREIGN PATENT DOCUMENTS

EP 58456 A1 * 8/1982
(Continued)

OTHER PUBLICATIONS

Denison Hydraulics; vane pumps : single, double & triple; General Catalog T7-T67-T6C series; Publ. 1—EN0740-B; 12/2002/2000/FB.

*Primary Examiner* — Theresa Trieu
(74) *Attorney, Agent, or Firm* — Edwards Angell Palmer & Dodge LLP; Scott D. Wofsy; George N. Chaclas

(57) ABSTRACT

A vane pump assembly including a cam ring having an elliptical inner bore defining a hydraulic pumping chamber, the pumping chamber having an interior camming surface. The cam ring defines ports for admitting fluid into the pumping chamber. A rotor, within the cam ring, defines a plurality of radial vane slots. A vane assembly is supported in each vane slot to define vane buckets. Each vane assembly has an end dynamic vane seal for reducing leakage between the buckets. Front and rear side plates, separated by an annular spacer, enclose the pumping chamber. The pump assembly may also include floating front and rear rotor seals for reducing radially inward leakage. Each rotor seal is disposed within a groove formed in the rotor, wherein discharge pressure urges the rotor seals axially outward from the pumping chamber to create an effective seal against the respective side plate.

22 Claims, 8 Drawing Sheets

U.S. PATENT DOCUMENTS

| | | | | |
|---|---|---|---|---|
| 5,545,014 | A | 8/1996 | Sundberg et al. | |
| 5,545,018 | A * | 8/1996 | Sundberg | 418/104 |
| 6,470,992 | B2 | 10/2002 | Nissen et al. | |
| 6,478,559 | B2 | 11/2002 | Bishop et al. | |
| 6,719,543 | B2 | 4/2004 | Gentile et al. | |

FOREIGN PATENT DOCUMENTS

| | | | | |
|---|---|---|---|---|
| GB | 2249139 A * | 4/1992 | | |
| JP | 06235384 A * | 8/1994 | | 418/146 |

* cited by examiner 8
7

BALANCED VARIABLE DISPLACEMENT VANE PUMP WITH FLOATING FACE SEALS AND BIASED VANE SEALS

CROSS-REFERENCE TO RELATED APPLICATION

This application claims priority to U.S. Provisional Patent Application No. 60/920,477, filed Mar. 28, 2007, which is incorporated herein by reference in its entirety.

BACKGROUND OF THE INVENTION

1. Field of the Invention

The subject invention is directed to a variable displacement vane pump, and more particularly, to a hydrostatically balanced multi-action variable displacement vane pump with variable cam timing, vane seals for reducing internal cross-bucket leakage, and floating face seals for reducing radial leakage.

2. Description of Related Art

Variable displacement vane pumps are well known in the art, and have been employed as fuel pumps in aircraft from many years. Most variable displacement vane pumps utilize a single lobe cam ring design, as disclosed for example in U.S. Pat. No. 5,545,014, 5,545,018 and 6,719,543, the disclosures of which are herein incorporated by reference in their entireties.

Typically, a circular cam member is employed about a relatively smaller circular rotor. Low pressure fluid is delivered to the rotor surface where the fluid is compressed within vane buckets. The compressed or high pressure fluid is then discharged through an outlet. When concentric, the pump provides zero or little fluid flow but when displaced to a position of maximum eccentricity, maximum fluid flow occurs. Under these conditions, large bearings are required to sustain the rotor reaction forces under high discharge pressure conditions. Further, these rotor reaction forces may disrupt or cause poor operation of the pump and/or poor operation of the system containing the pump.

For a variable displacement pump, it is desirable for the pump to be a balanced pump to mitigate the effects of the internal forces. Thus, many fixed displacement vane pumps use a balanced rotor arrangement, wherein bearing loads are eliminated by providing multiple lobes (e.g., two or even three lobes) on a cam ring. For example, see U.S. Pat. No. 4,272,227 and 6,478,559, the disclosures of which are herein incorporated by reference in their entireties. Such high-pressure vane pumps for aircraft applications and the like must be designed with cost, size, weight, complexity, performance and durability requirements in mind. In order to achieve the high performance requirements, efforts should be made to reduce possible internal leakage due to the low viscosity of the operation fluid, which is fuel.

In view of the above there is a need for an improved pump that is well-balanced, has improved vane assemblies, achieves better sealing and leakage control, and has parts which serve multiple functions to simplify design.

The subject invention is directed to a balanced variable displacement pump in the form of a pump cartridge that has a dual-action pumping element with an improved seal design to reduce internal cross-port leakage within the pumping element, and which also has a variable cam ring for selectively changing the effective displacement of the pump with a minimum amount of control torque. The benefits associated with the subject invention include high durability, high efficiency, easy displacement control, compact size and low cost.

SUMMARY OF THE INVENTION

The subject invention is also directed to a new and useful hydrostatically balanced dual action variable displacement vane pump cartridge assembly. The assembly includes a rotary cam ring having an outer circumferential surface and an elliptical inner bore defining a hydraulic pumping chamber that has a continuous interior camming surface. A rotor is mounted for axial rotation within the inner bore of the cam ring, driven by an axial drive shaft. The rotor has an axial cavity for cooperatively receiving a drive shaft and includes a plurality of circumferentially spaced apart radially extending vane slots, each for accommodating a respective vane. As a benefit, this dual-action pumping element places no significant hydraulic load on the drive shaft.

A vane is supported in each radially extending vane slot to define a plurality of circumferentially spaced vane buckets or pressure chambers. The vane slots communicate with an annular groove formed in the interior surface of the axial cavity of the rotor through radially extending bores. An undervane pin is disposed within each radially extending bore, and discharge pressure directed to the annular groove of the rotor acting on the undervane pins pushes the vanes radially outwardly against the camming surface of the cam ring. A cylindrical sleeve is positioned within the axial cavity of the rotor to seal the annular groove in the rotor.

An annular spacer surrounds the rotary cam ring and defines an interior bearing surface to accommodate selective rotation of the cam ring for varying the effective displacement of the pumping chamber. Front and rear side plates, separated by the annular spacer, enclose the pumping chamber of the cam ring. Each side plate has two diametrically opposed outboard inlet ports for admitting low pressure fluid into the pumping chamber and at least the front side plate has two diametrically opposed inboard discharge ports for discharging high pressure fluid from the pumping chamber. The cam ring includes pairs of diametrically opposed inlet ports for admitting low-pressure fluid into the pumping chamber in conjunction with the inlet ports of the side plates. The annular groove in the rotor is linked to discharge pressure through a plurality of angled boreholes extending through the rotor that communicate with the discharge ports in the side plates.

In a preferred embodiment of the subject invention, a swing arm extends from the rotary cam ring, through an arcuate slot formed in the annular spacer for actuating the cam ring, and a drive mechanism is provided for actuating the swing arm to move the cam ring within the annular spacer relative to the side plates.

Preferably, a pump assembly in accordance with the subject disclosure includes axially floating annular face seals positioned between the rotor faces and the inner surfaces of the front and rear side plates. These dynamic face seals are pushed against the respective side plates by the discharge pressure of the pump to reduce radial leakage within the pump cartridge.

Preferably, a dual action variable displacement vane pump of the subject invention includes an even number of vane elements, and more preferably it includes at least ten (10) vanes. However, those skilled in the art will readily appreciate that more or fewer vanes can be employed to define additional or fewer volume chambers or vane buckets. Furthermore, those skilled in the art will readily appreciate that the subject pump assembly can be configured as a multi-action pump assembly, rather than simply a dual action pump assembly, so long as the pump remains hydrostatically balanced.

In accordance with a preferred embodiment of the subject invention, each vane has dual radially outer vane tips and dual front and rear vane tips for maintaining the hydrostatic balance of the vane. In addition, two radial bores extend through each vane to allow fluid discharge pressure to act on the overvane surface, further maintaining the hydrostatic balance of the vane. Preferably, each vane has front and rear spring loaded dynamic face seals that act against the front and rear face plates to reduce circumferential leakage between adjacent vane buckets or volume chambers.

In a preferred embodiment, the subject disclosure is directed to a variable displacement vane pump assembly including a rotary cam ring having an elliptical inner bore defining a hydraulic pumping chamber, the pumping chamber having a continuous interior camming surface, the rotary cam ring also defining ports for admitting fluid into the pumping chamber. A rotor mounts the cam ring and defines a plurality of radially extending vane slots. A vane assembly is supported in each vane slot to define a plurality of circumferentially spaced vane buckets. Each vane assembly has a vane seal on each end of each vane assembly for reducing circumferential leakage between the buckets. An annular spacer surrounds the cam ring. The front and rear side plates, separated by the annular spacer, enclose the pumping chamber.

The pump assembly may also include floating front and rear rotor seals for reducing radially inward leakage. Each rotor seal is disposed within a groove formed in the rotor, wherein the high pressure fluid urges the front and rear rotor seals axially outward from the pumping chamber to create an effective seal between the rotor seals and the respective side plate.

In another embodiment, the subject technology is directed to a variable displacement pump assembly including a rotary cam ring having an outer circumferential surface and an elliptical inner bore defining a hydraulic pumping chamber. The pumping chamber has a continuous interior camming surface and the rotary cam ring defines at least one port for admitting low pressure fluid into the pumping chamber. A rotor mounts for axial rotation within the inner bore of the rotary cam ring. An annular spacer surrounds the rotary cam ring and defines an interior bearing surface to accommodate selective rotation of the cam ring for varying the effective displacement of the pumping chamber. The annular spacer also defines at least one passage in fluid communication with the at least one port for admitting low pressure fluid into the pumping chamber. Front and rear side plates, separated by the annular spacer, enclose the pumping chamber. The front side plate defines at least one discharge port for discharging high pressure fluid from the pumping chamber. At least one screw fixes the annular spacer, the front side plate and the rear side plate together with respect to the rotary cam ring as well as provides a mechanical stop for movement of the rotary cam ring.

It is envisioned that the variable displacement vane pump assembly may also have vane assemblies with front and rear spring loaded dynamic face seals acting against the front and rear face plates, to reduce circumferential leakage between adjacent vane buckets.

These and other features and benefits of the fully balanced variable displacement vane pump subject invention and the manner in which it is employed will become more readily apparent to those having ordinary skill in the art from the following enabling description of the preferred embodiments of the subject invention taken in conjunction with the several drawings described below.

BRIEF DESCRIPTION OF THE DRAWINGS

So that those skilled in the art to which the subject invention appertains will readily understand how to make and use the hydrostatically balanced variable displacement vane pump of the subject invention without undue experimentation, preferred embodiments thereof will be described in detail hereinbelow with reference to certain figures, wherein.

DETAILED DESCRIPTION OF PREFERRED EMBODIMENTS

Figure 1:
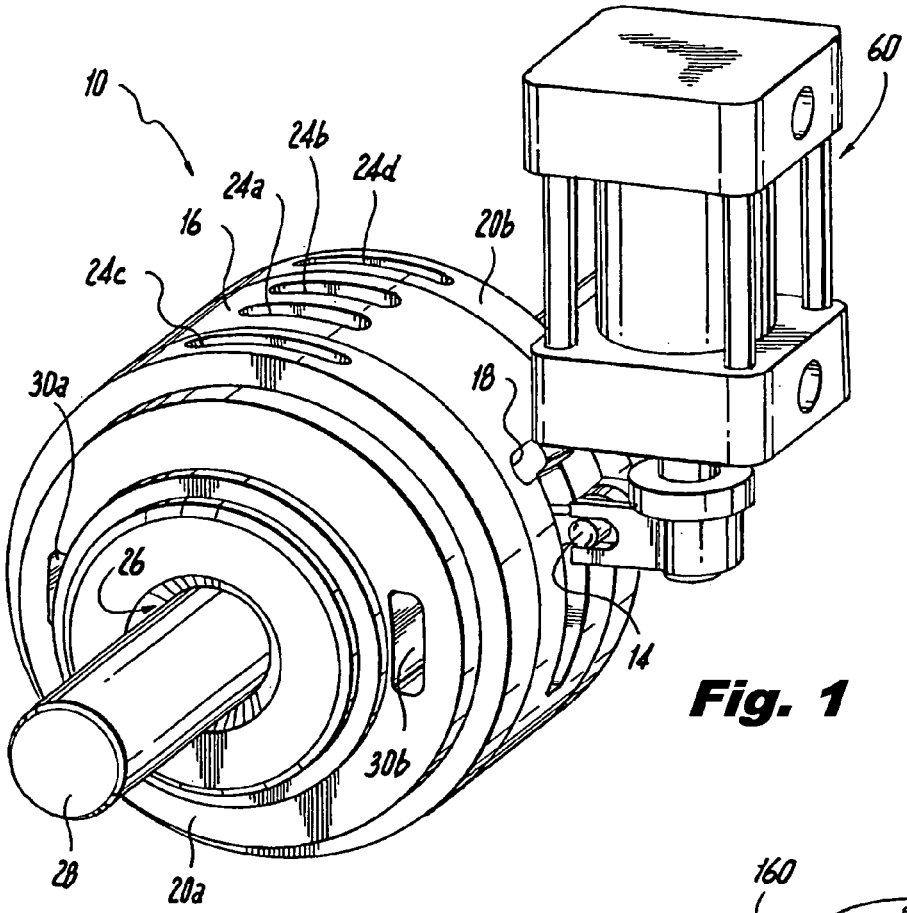
FIG. 1 is a perspective view of the vane pump assembly of the subject disclosure with a linear actuator such as a hydraulic cylinder or solenoid actuator for actuating the swing arm of the rotary cam ring to selectively vary the effective displacement of the vane pump assembly.
Figure 2:
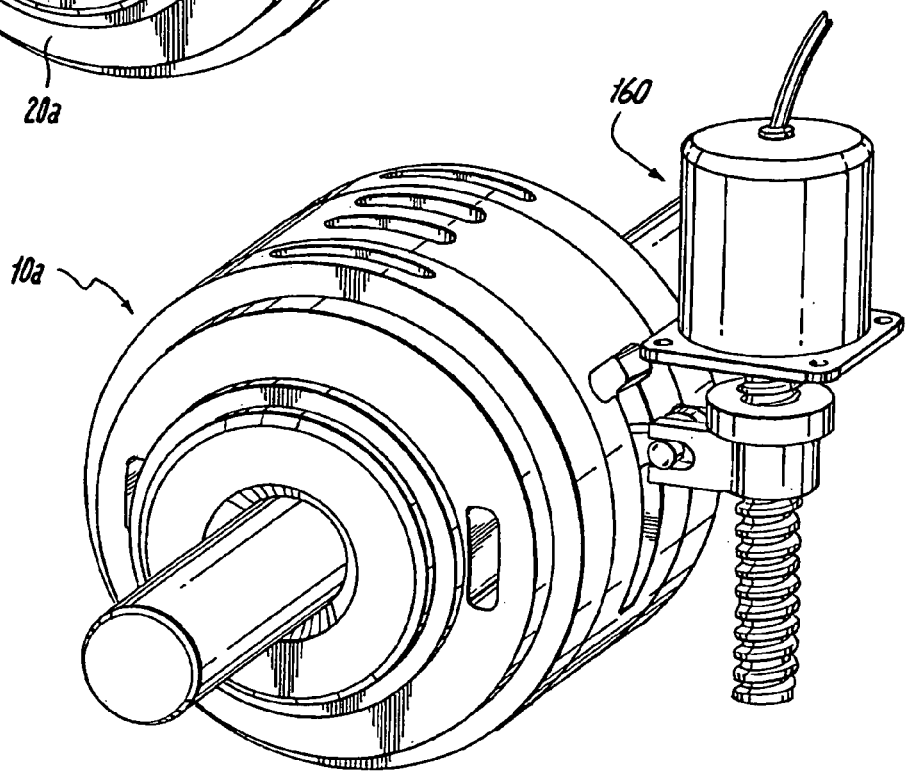
FIG. 2 is another perspective view of the vane pump assembly of the subject disclosure with a rotary actuator such as a screw driven motor, axial slider or cam for actuating the swing arm of the rotary cam ring to selectively vary the effective displacement of the vane pump assembly.

Referring now to the drawings wherein like reference numerals identify similar structural feature or elements of the subject invention, there are illustrated in FIGS. 1 and 2 two versions of a fully hydrostatically balanced variable displacement vane pump constructed as a cartridge assembly and designated generally by reference numerals 10 and 10*a*, respectively. The cartridge or pump assemblies 10, 10*a* are configured to fit within a reusable housing (not shown). In other words, the pump assemblies 10, 10*a* can be readily replaced when worn or in need of repair. All relative descriptions herein such as front, rear, side, left, right, up, and down are with reference to the Figures, and not meant in a limiting sense.

Vane pump assemblies 10, 10*a* are substantially identical except for the respective drive mechanism 60, 160 used to control the displacement of the pump assemblies 10, 10*a*. As shown in FIG. 1, the drive mechanism 60 may be a linear actuator such as a hydraulic cylinder or solenoid actuator to selectively vary the effective displacement of the pump assembly 10. In particular, the drive mechanism 60 of FIG. 1 is a solenoid-drive mechanism.

In the alternative embodiment shown in FIG. 2, the pump assembly 10*a* has a rotary actuator drive mechanism 160 such as a screw driven motor, axial slider or cam to selectively vary the effective displacement of the vane pump. In particular, the rotary actuator 160 of FIG. 2 is a screw-drive mechanism. With either drive mechanism 60, 160, a controller (not shown) communicates with the drive mechanism to selectively vary the output of the pump assemblies 10, 10*a*.

Referring only to FIG. 1 for simplicity, the pump assembly 10 includes two sets of outboard inlet ports 24*a-d* for admitting low pressure fluid into the pump assembly 10. Only the first set of inlet ports 24*a-d* is shown as the second set of inlet ports 24*a-d* diametrically opposes the first set. In other words for reference, if the first set of inlet ports 24*a-d* were oriented at the top or twelve o'clock position, the second set of inlet ports 24*a-d* would be oriented at the bottom or six o'clock position. By passing through the pump assembly 10, the low pressure fluid becomes high pressure fluid and exits by at least one set of diametrically opposed discharge ports 30*a*, 30*b*. A similar set of discharge ports may be present at the back of the pump assembly 10. By having diametrically opposed inlets 24*a-d* and opposing discharge ports 30*a*, 30*b*, the forces generated thereby effectively cancel to provide a balanced pump assembly 10. The high pressure discharge ports 30*a*, 30*b* are through slots and can be connected to open ends of a shell or cartridge for balance and ultimately the flow passes through a pump assembly outlet.

The pump assembly 10 includes fixed front and rear side plates 20*a*, 20*b*, which are separated from one another by an annular spacer 16. The inlet ports 24*a*, 24*b* are formed in the annular spacer 16. The inlet port 24*c* and discharge ports 30*a*, 30*b* are formed in the front side plate 20*a*. In a preferred embodiment, the rear side plate 20*b* not only forms the inlet port 24*d* but discharge ports (not shown) similar to the discharge ports 30*a*, 30*b* formed in the front side plate 20*a*.

The front and rear side plates 20*a*, 20*b* form an axial passageway 26 through which a drive shaft 28 passes to attach to a rotor assembly 40. The front and rear side plates 20*a*, 20*b* along with the annular spacer 16 combine to also form an interior or pumping chamber 42 that houses a rotary cam ring 12 and rotor assembly 40 (see FIG. 4).

Figures 6, 7:
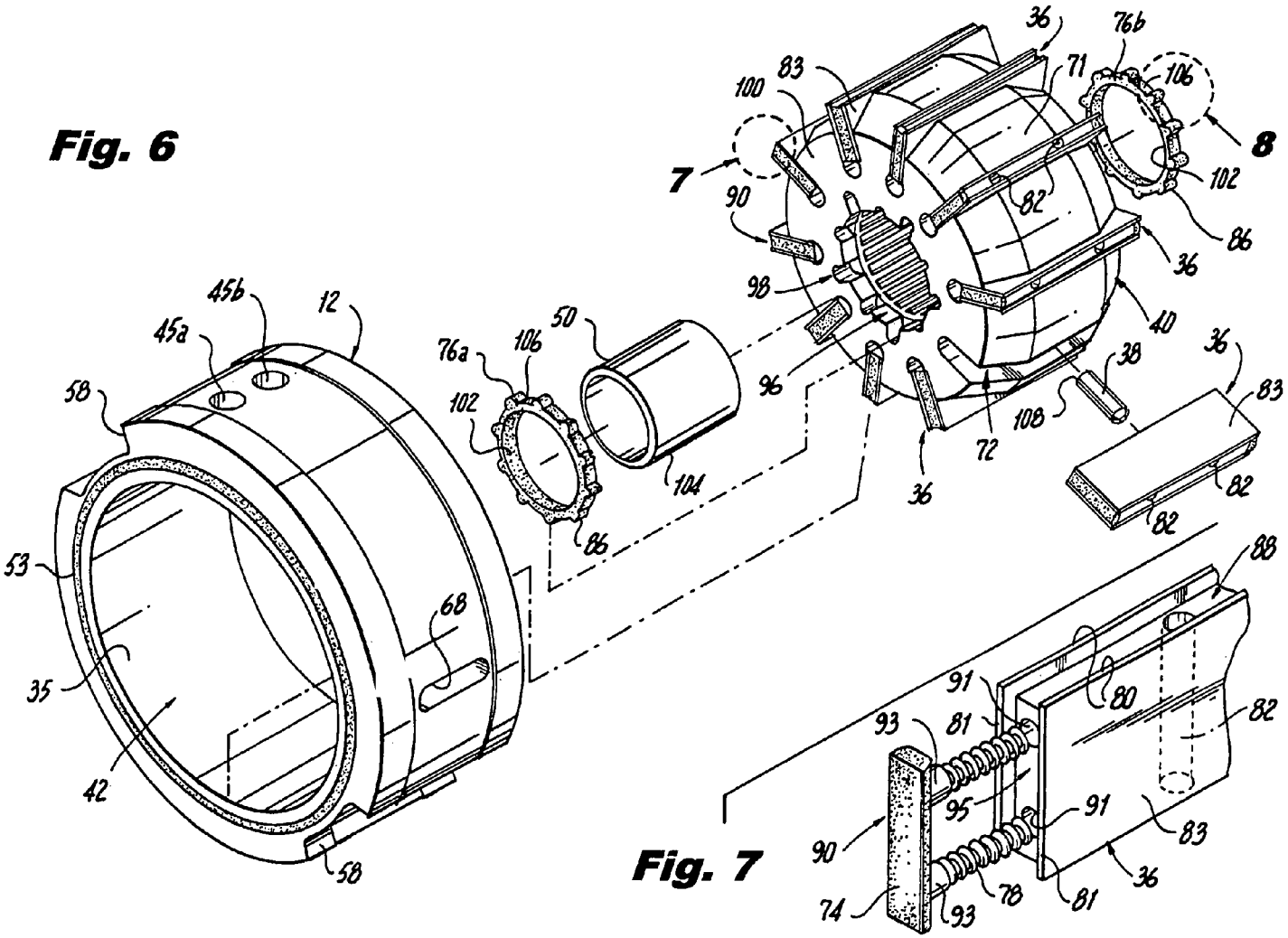
FIG. 6 is an exploded perspective view illustrating the rotor assembly with the cam ring removed.
FIG. 7 is a perspective exploded view of the vane seal assembly within area "7" of FIG. 6 to illustrate the biasing springs.

Still referring to FIG. 1, the rotary cam ring 12, best seen in FIG. 6, is coupled to a swing arm 14. The annular spacer 16 surrounds the rotary cam ring 12 and has a T-shaped arcuate slot 18 for accommodating motion of the swing arm 14. The drive mechanisms 60, 160 couple to the swing arm 14 in order to control position of the rotary cam ring 12. By moving the rotary cam ring 12, the drive mechanisms 60, 160 can vary the output of the pump assembly 10.

Figure 3:
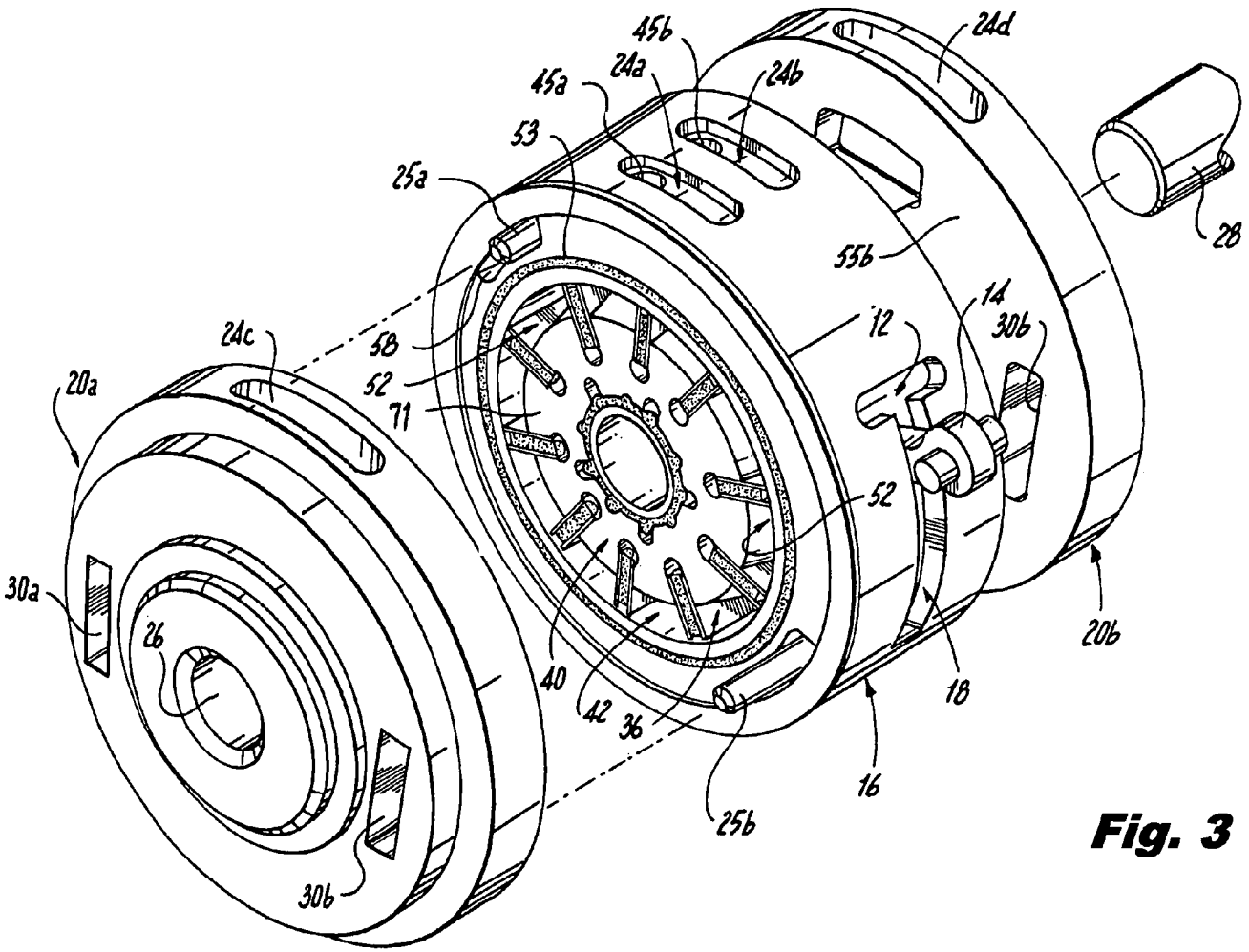
FIG. 3 is a perspective view of the pump assembly of the subject disclosure with the front side plate removed to illustrate the rotor assembly, which is mounted for axial rotation within an elliptical pumping chamber defined by the cam ring.

Referring to FIG. 3, a perspective view of the pump assembly 10 is shown with the front side plate 20 removed to illustrate the rotor assembly 40 housed in the pumping chamber 42. The cam ring 12 surrounds the rotor assembly 40 and forms two opposing pairs of opposing inlet passages 45*a*, 45*b* that align with the inlet ports 24*a*, 24*b* of the annular spacer 16. The inlet passages 45*a*, 45*b* allow low pressure fluid to pass into the pumping chamber 42, in a radial direction, and inlet passages 24*c* and 24*d* on side plates 20*a*, 20*b* allow low pressure fluid to pass into the pumping chamber 42, in the axial direction.

Figure 10:
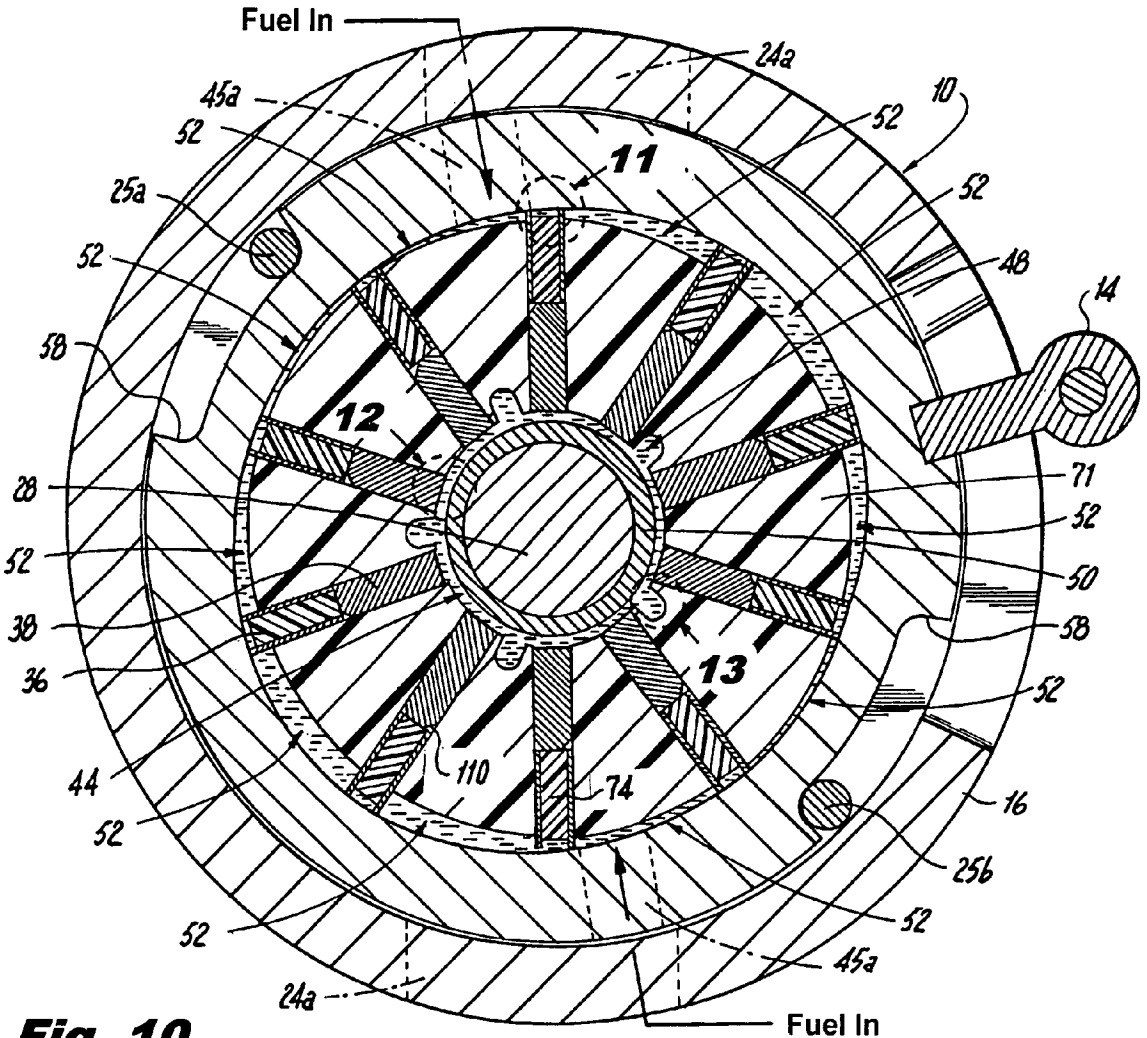
FIG. 10 is a cross-sectional view of the pump assembly of the subject disclosure, illustrating the relative position of the rotor and cam ring when the cam ring is positioned to achieve full displacement, and the resulting diametrically opposed minimum and maximum bucket volumes associated therewith.

The rotor assembly 40 is mounted on the drive shaft 28 for axial rotation within the pumping chamber 42. The rotor assembly 40 includes a rotor body 71, which fits within an elliptical pumping chamber surface 35 defined by the cam ring 12 as best seen in FIG. 6. The rotor body 71 includes a plurality of radially outwardly acting vane assemblies 36 which normally contact the elliptical pumping chamber surface 35. As described in more detail below, a plurality of circumferential vane buckets or volume chambers 52 are formed between the rotor body 71, the elliptical pumping chamber surface 35 and the vane assemblies 36 as best seen in FIG. 10. A seal or o-ring 53 fits in a groove of the cam ring 12 in order to prevent radial leakage outwards.

Figure 4:
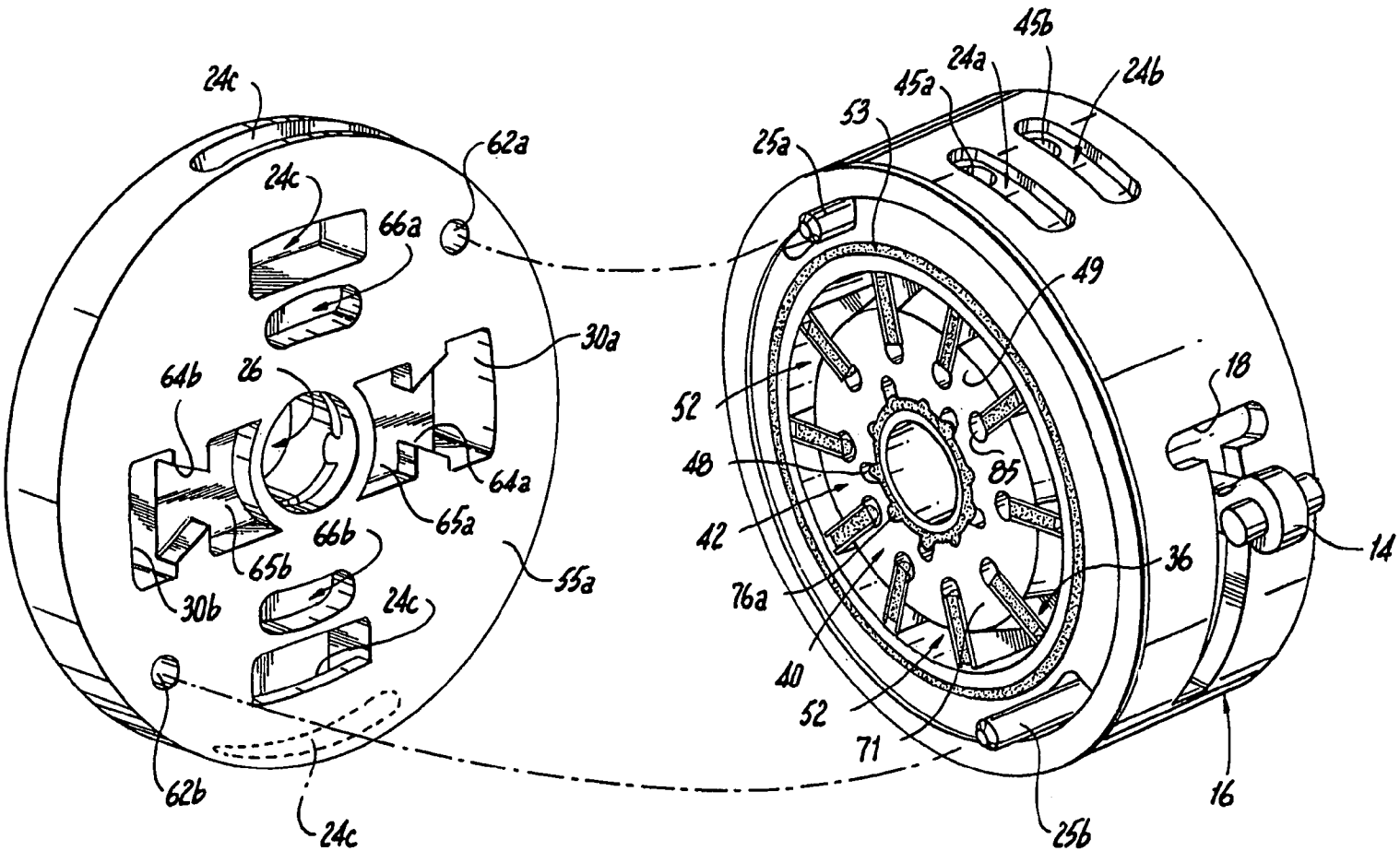
FIG. 4 is another perspective view of the pump assembly of the subject disclosure with the front side plate removed and pivoted to illustrate the inner face of the front side plate and the diametrically opposed screws or fasteners that cooperate with the rotary cam ring and side plates, to hold the cartridge assembly together as well as serving as mechanical stops for limiting the rotational extent of the cam ring.

Referring additionally to FIG. 4, the front side plate 20*a* is shown pivoted away from the rotor assembly 40 to fully illustrate the inner face 55*a* of the front side plate 20*a*. Preferably, the inner face 55*b* of the rear side plate 20*b*, partially shown in FIG. 3, is substantially a mirror image of the front side plate inner face 55*a*.

Diametrically opposed screws or fasteners 25*a*, 25*b* pass through open slots 58 in the cam ring 12 to retain the side plates 20*a*, 20*b* about the annular spacer 16, i.e., to hold the pump assembly 10 together. The screws 25*a*, 25*b* pass through slots 58 in the cam ring 12 to serve as mechanical stops for limiting the rotational extent of the cam ring 12. The front side plate 20 has threaded bores 62*a*, 62*b* for coupling to the screws 25*a*, 25*b* whereas the rear side plate 20*b* may simply have through bores (not shown).

The inner faces 55*a*, 55*b* also form flow paths 64*a*, 64*b* from the discharge ports 30*a*, 30*b*. The flow paths 64*a*, 64*b* may have a funnel-shaped portion that terminates in substantially rectangular reservoirs 65*a*, 65*b*. By being in fluid communication with the discharge ports 30*a*, 30*b*, the reservoirs 65*a*, 65*b* collect fluid at discharge pressure. Periodically, the reservoirs 65*a*, 65*b* are in fluid communication with angled bores 48 formed in the rotor assembly 40 as described in more detail below and best seen in FIG. 9. The front and rear side plates 20*a*, 20*b* also form pairs of inboard inlet pressure end zones or pockets 66*a*, 66*b*. The inlet pressure zones 66*a*, 66*b* are radially outside of the angled bores 48 and periodically align with the vane slots 72, best seen in FIG. 6. The inlet pressure zones 66*a*, 66*b* also are at inlet pressure, thus the inlet pressure zones 66*a*, 66*b* function to maintain the hydrostatic balance of the vane body 83 in a radial direction at the inlet zone.

Figure 5:
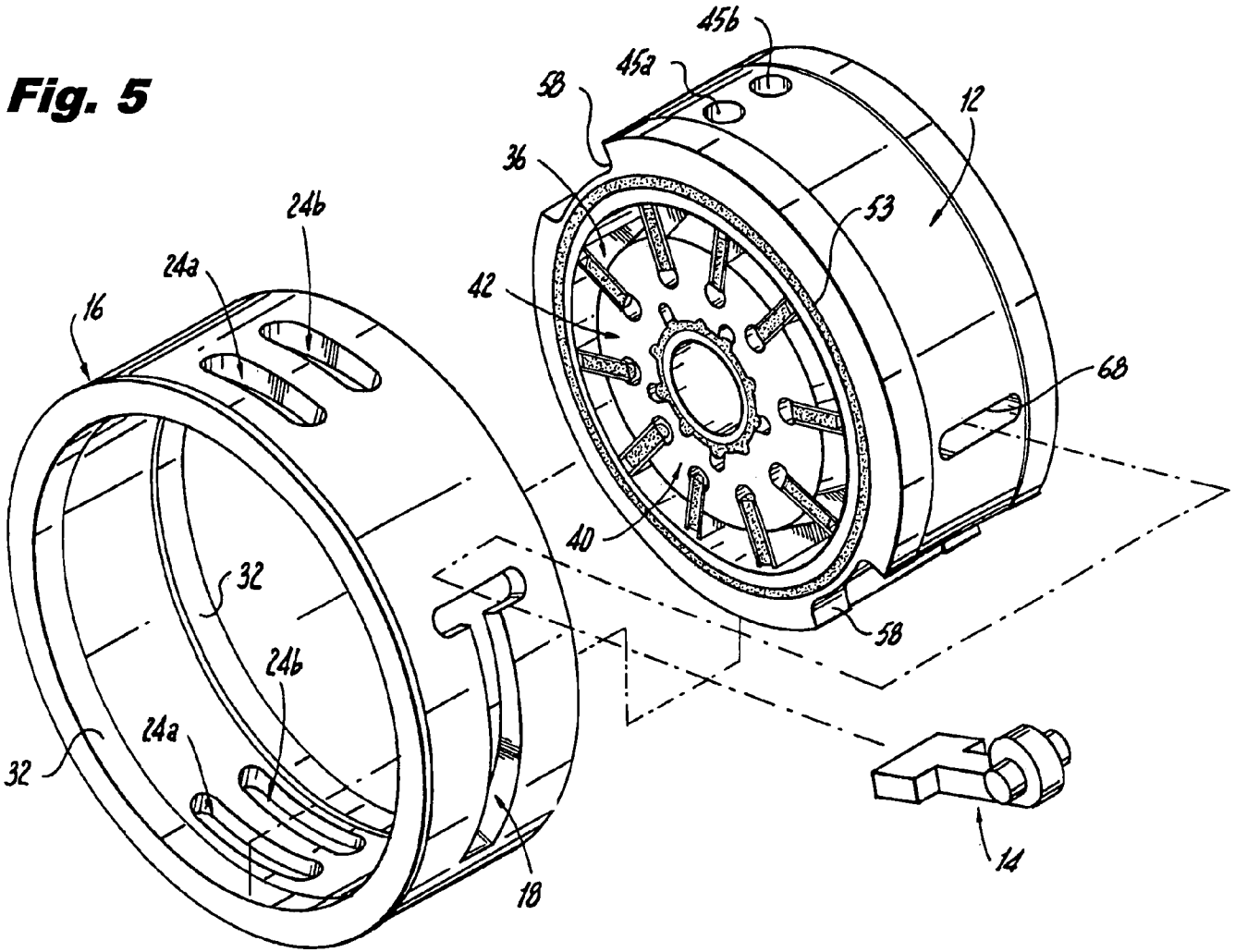
FIG. 5 is an exploded perspective view illustrating the annular spacer which separates the two side plates with the cam ring surrounding the rotor assembly.

Referring now to FIG. 5, a perspective view of the annular spacer 16 is shown separated from the cam ring 12 and rotor assembly 40. The annular spacer 16, which separates the two side plates 20*a*, 20*b*, includes an inner bearing surface 32 for accommodating rotation of the cam ring 12 relative to the side plates 20*a*, 20*b* through actuation of the swing arm 14. Movement of the swing arm 14 varies the effective displacement of the pump assembly 10. The swing arm 14 passes through the T-shaped slot 18 in the annular spacer 16 to fixedly couple to a mounting slot 68 in the cam ring 12. In an alternative embodiment, the T-shaped slot 18 acts to mechanically limit the travel of the swing arm 14.

Referring now to FIG. 6, a perspective view of the rotor assembly 40 of the pump assembly 10 is shown with the annular spacer 16 and one vane assembly 36 separated therefrom. The rotor assembly 40 has a rotor body 71 that defines an axial cavity 70 and a plurality of circumferentially spaced apart radially extending vane slots 72. A vane assembly 36 is slidably supported in each radially extending vane slot 72 to maintain contact with the elliptical pumping chamber surface 35.

As noted above, by maintaining contact with the elliptical pumping chamber surface 35 of the cam ring 12, the vane assemblies 36 create moving seals, which help to form the vane buckets 52 in which fluid compression occurs as the rotor body 71 spins. A single undervane pin 38 is disposed axially inward from each vane assembly 36 to push the respective undervane assembly 36 radially outwardly against the pumping chamber surface 35 of the cam ring 12 as described in more detail below with respect to FIG. 10.

Each vane assembly 36 has a rectangular vane body 83. The vane body 83 has dual outer vane lips 80 that contact the elliptical pumping chamber surface 35 to maintain the dynamic seal there between. By having two outer vane lips 80 on each vane body 83, some measure of hydrostatic balance can be maintained across the dynamic seals during pump assembly operation.

To balance undervane pressure, the vane body 83 has dual flow bores 82 that are in fluid communication with the axial cavity 70 of the rotor body 71 as described below with respect to FIG. 10. The dual flow bores 82 open into a channel 88 formed intermediate the outer vane lips 80. Preferably, the vane body 83 is fabricated from a hardened steel such as by metal injection molding. The vane assembly 36 also has a dynamic facial seal assembly 90 to reduce circumferential leakage between adjacent vane buckets 52.

Referring to FIG. 7, a perspective exploded view of the facial seal assembly 90 within area "7" of FIG. 6 is shown. The facial seal assembly 90 includes sealing bumpers 74 on each end portion 92. Each sealing bumper 74 is pressed against the respective side plates 20*a*, 20*b* by two springs 78 extending from hollows 91 formed in the vane body 83. The springs 78 attach to collars 93 on the sealing bumpers 74.

Each vane body 83 also forms a channel 95 in each end portion 92. Each channel 95 extends up to the dual side vane lips 81 so that the respective sealing bumper 74 can nestle into the channel 95 in a flush or near flush manner when not extended. Thus, the facial seal assemblies 90 move in both the radial and circumferential directions during operation of the pump assembly 10.

Referring again to FIG. 6, the rotor assembly 40 also includes dynamic front and rear rotor face seals 76*a*, 76*b*, which function to reduce radially inward leakage to the axial cavity 70. Each dynamic rotor face seal 76*a*, 76*b* floats in a groove 96 formed in the rotor body 71. The face seals 76 are relatively thinner than the grooves 96 so that mechanical interference between the side plates 20*a*, 20*b* is minimal, if any. VESPEL®, available from E. I. du Pont de Nemours and Company of Delaware, U.S.A., is a preferred material for the face seals 76*a*, 76*b*.

The face seals 76 have circumferentially spaced apart tabs 86 that reside within corresponding recesses 98 formed around the groove 96 in the front and rear faces 100 of the rotor body 71. By having the tabs 86 in the recesses 98, the face seals 76*a*, 76*b* rotate together with the rotor body 71. The rotor body 71 also defines angled bores 48 adjacent to every other recess 98 as described in more detail below with respect to FIG. 9. Discharge pressure seeps from the angled bores 48 to provide fluidic pressure against the face seals 76*a*, 76*b*.

A cylindrical sleeve 50 disposed in the axial cavity 70 extends partially into the inner diameter 102 of each face seal 76*a*, 76*b*. The size and configuration of the sleeve 50 is such that the sleeve outer diameter 104 creates a floating seal contact area with the inner diameter 102 of the seals 76*a*, 76*b*. Similarly, another sealing area is created between the outer diameter 106 of the seals 76*a*, 76*b* and the respective groove 96. The face seals 76*a*, 76*b* may have a slight taper so that high pressure fluid in the axial cavity 70 can at least partially surround the inner and outer diameters 102, 106 to create robust floating with a relatively thin seal and, thereby, reduce force on the rotor body 71.

Figure 8:
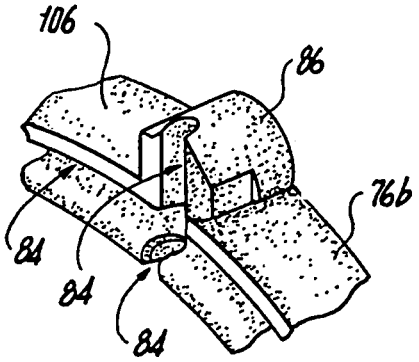
FIG. 8 is a detailed view of the face seal assembly within area "8" of FIG. 6 to illustrate one of the anti-rotation tabs.

Referring to FIG. 8, a detailed view of the floating face seal 76*b* within area "8" of FIG. 6 is shown. The dynamic face seals 76*a*, 76*b* are formed with channels 84 that cup high-pressure discharge fluid from the axial cavity 70. As a result, the seals 76*a*, 76*b* are pushed axially outwardly to effectively seal against the front and rear side plates 20*a*, 20*b*, respectively, by the discharge pressure of the pump assembly 10.

Figure 9:
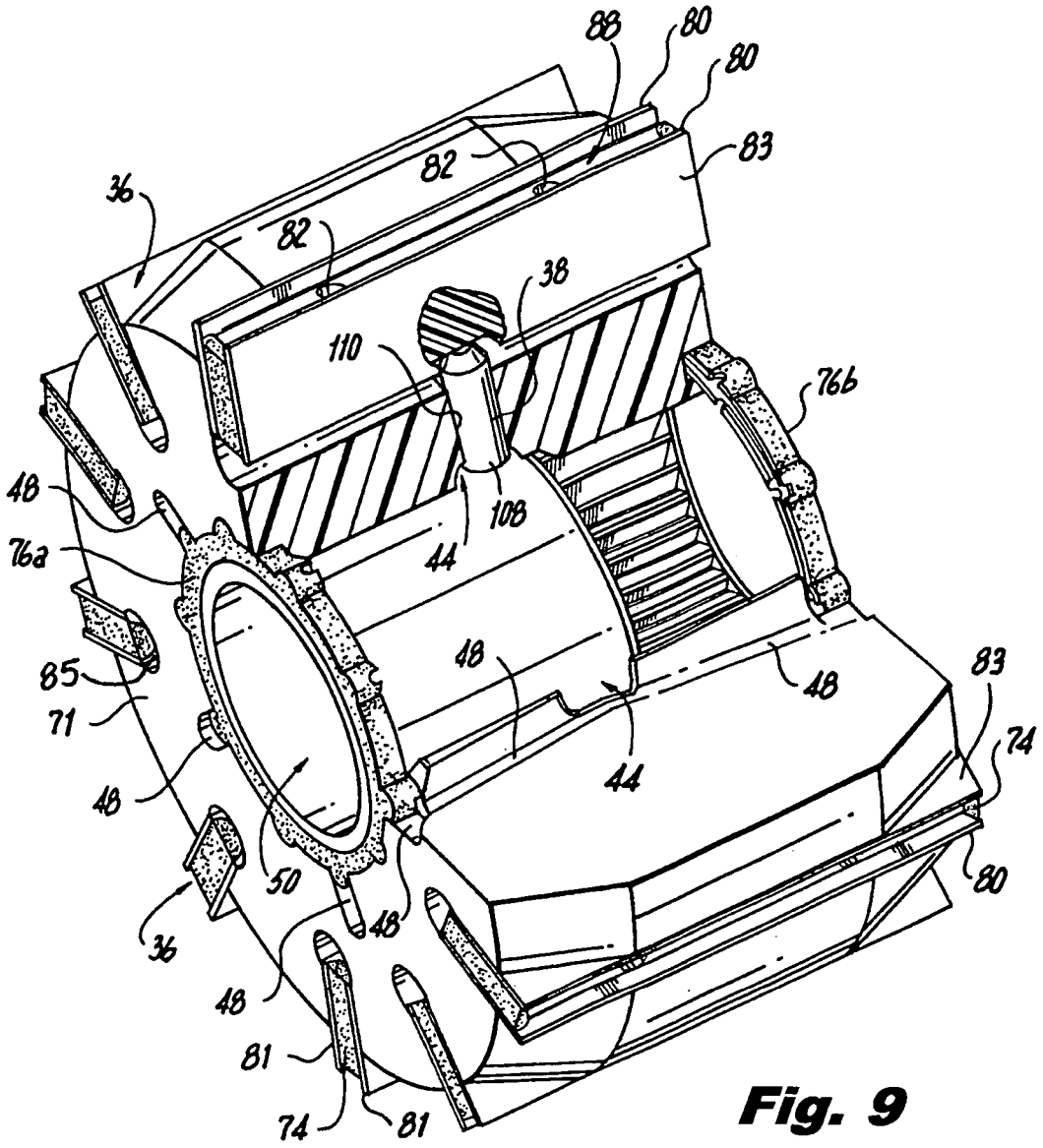
FIG. 9 is a perspective view of the rotor assembly, in partial cross-section, illustrating one of the undervane pins that functions to push the respective vane assembly in a radially outward direction within the radial vane slot.

Referring now to FIG. 9, a perspective view of the rotor assembly 40, in partial cross-section, illustrates one of the undervane pins 38 that functions to push the respective vane assembly 36 in a radially outward direction within the radial vane slot 72. Each pin 38 is positioned in a radial bore 110 that is in fluid communication with a central annular groove 44 formed in the rotor body 71.

The central annular groove 44 provides discharge pressure to the radially inward end 108 of the undervane pins 38. The discharge pressure comes from the angled bores 48. Preferably, at least one of the angled bores 48 formed in the rotor body 71 is always in communication with the discharge pressure in the flow paths 64*a*, 64*b* adjacent to the discharge ports 30*a*, 30*b*.

The cylindrical sleeve 50, positioned in the axial cavity 46 of rotor body, seals the central annular groove 44 to maintain the discharge pressure against the undervane pins 38 of the rotor 34. Thus, the undervane pins 38 are energized to push each vane assembly 36 radially outwardly against the cam ring 12.

Still referring to FIG. 9, the radial bores 110 of the rotor body 71 are also in fluid communication with the vane channels 88 so that overvane pressure is also provided into the dual flow bores 82 of the vane body 83. Accordingly, overvane pressure is provided through the vane body 83 to the vane slots 72. As a result, undervane and overvane pressure are balanced. The overvane pressure also fills the channels 95 behind the bumpers 74, which are periodically in fluid communication with the outlet pressure zones 65*a*, 65*b* or the discharge pressure zones 66*a*, 66*b* of the respective side plates 20*a*, 20*b*. Consequently, the vane assemblies 36 also perform pumping like stroking pistons, i.e., undervane pumping as described in more detail below.

Referring now to FIG. 10, a cross-sectional view of the pump assembly 10 with the relative positions of rotor 34 and cam ring 12 to operate the pump assembly at full displacement is shown. In contrast, FIG. 14 shows a cross-sectional view of the pump assembly with the relative positions of rotor 34 and cam ring 12 de-stroked 27° so that the effective displacement of pump assembly 10 is reduced to 25% of the full displacement volume.

In FIG. 10, during operation at full displacement, the low pressure fluid enters through the two sets of inlet ports 24*a-d* and flows into the vane buckets 52. Inlet ports 24*a*, 24*b* provide flow radially to the inlet area, approximately at the 12 o'clock position, whereas inlet ports 24*c*, 24*d* provide flow axially to the inlet area. The cam ring 12 is positioned about the rotor body 71 so that maximum size vane buckets 52 are created at approximately the 2 o'clock and 8 o'clock positions whereas minimum size vane buckets 52 are created at approximately the 4 o'clock and 10 o'clock positions as the rotor body 71 rotates counterclockwise. The movement of the fluid through the varying size vane buckets causes compression so that the fluid is pressurized during rotation.

Figure 14:
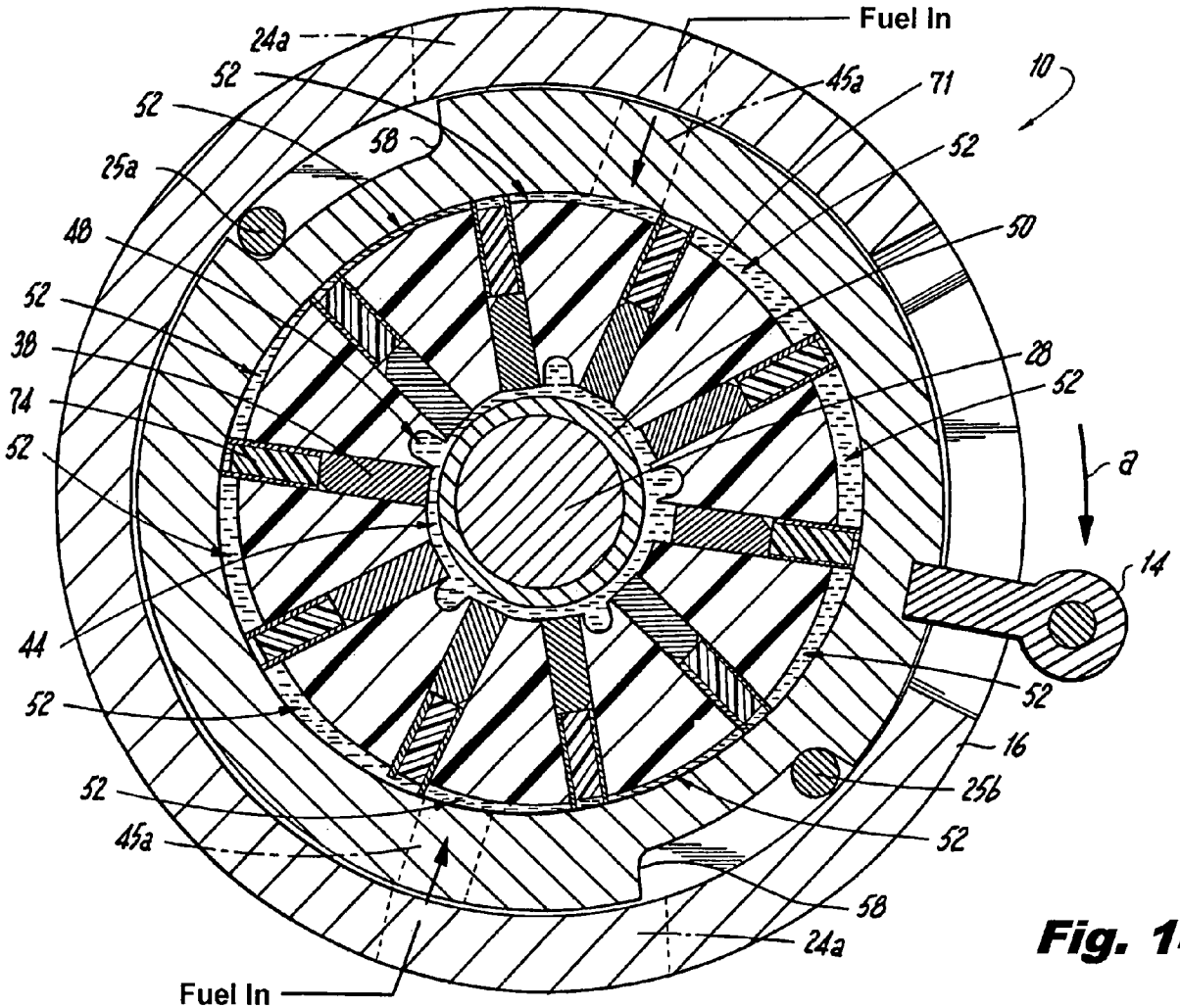
FIG. 14 is a cross-sectional view of the pump assembly of the subject disclosure, illustrating the relative position of the rotor and cam ring when the cam ring is de-stroked 27° to a position in which the effective displacement of the pump is reduced by 25%.

In FIG. 14, the swing arm 14 is driven clockwise along arrow "a" by the relevant drive mechanism 60, 160. During operation at lower displacement, the low pressure fluid also enters through the two sets of inlet ports 24*a-d* and flows into the vane buckets 52. However, the cam ring 12 is positioned about the rotor body 71 so that the larger size vane buckets 52, created at approximately the 2 o'clock and 8 o'clock positions, are relatively smaller than those of FIG. 10. Conversely, the smaller size vane buckets 52, created at approximately the 4 o'clock and 10 o'clock positions, are relatively larger that those of FIG. 10. As a result, even though the rotor body 71 still rotates to move and energize the fluid, the relative displacement is reduced.

Figure 11:
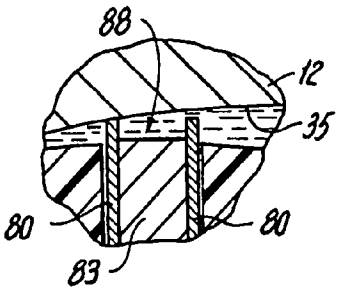
FIG. 11 is a detailed view that corresponds to area "11" of FIG. 10, illustrating the vane in contact with the cam ring.

Referring to FIG. 11, in both full displacement or destroked positions, the vane assemblies 36 contact the elliptical camming surface 35 of the cam ring 12. As shown, at least one of the vane lips 80 maintains contact so that leakage between the vane buckets 52 does not occur there across. Additionally, the bumpers 74 of the dynamic facial seal assemblies 90 seal against the respective side plates 20*a*, 20*b* to reduce circumferential leakage between adjacent vane buckets 52.

Figure 12:
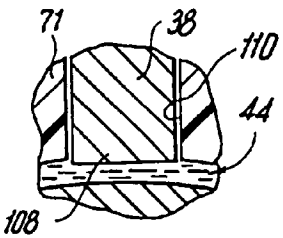
FIG. 12 is a detailed view that corresponds to area "12" of FIG. 10, illustrating the undervane pins in fluid communication with charged fluid.
Figure 13:
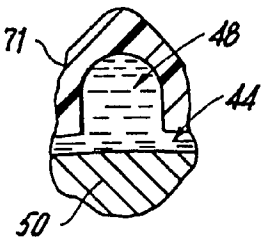
FIG. 13 is a detailed view that corresponds to area "13" of FIG. 10, illustrating an angled bore of the rotor body.

As the pressurized fluid reaches the discharge ports 30*a*, 30*b*, i.e., the discharge zone at approximately the 3 o'clock and 6 o'clock positions, the fluid flows into the discharge ports 30*a*, 30*b*. Fluid also flows into the flow passages 64*a*, 64*b* adjacent the discharge ports 30*a*, 30*b*. As at least one of the angled bores 48 (see FIG. 13) is always is fluid communication with the flow passages 64*a*, 64*b*. Thus, discharge pressure is consistently supplied to the undervane pins 38 via the central annular groove 44 as shown in FIG. 12. The discharge pressure also passes around the undervane pins 48 through the radial bores 82 of the vane bodies 83 to maintain balance as well. Radially inward leakage from the pumping chamber 42 is prevented by the floating face seals 76*a*, 76*b*.

The pump assembly 10 also has a secondary pumping effect. The two inlet pressure zones 66*a*, 66*b* are filled by fluid passing from the dual flow bore 82 in the vane bodies 83 when each vane assembly 36 is in the inlet zone of the pump assembly 10. The inlet pressure zones 66*a*, 66*b* are blind reservoirs with no connection to the open end of pump assembly 10. The inlet pressure zones 66*a*, 66*b* are used to keep the area 85 radially under the vane assemblies 36 at steady inlet pressure by establishing fluid communication between multiple areas 85 in the pump inlet area. Similarly, the discharge pressure reservoirs 65*a*, 65*b* are used to keep the undervane areas 85 appropriately at steady discharge pressure by establishing fluid communication between multiple undervane areas 85 in the pump discharge area.

The flow between the discharge pressure reservoirs 65*a*, 65*b* and the inlet pressure zones 66*a*, 66*b* creates additional pumping action. In other words, the vane assemblies 36 are also pumping via radial stroking due to the discharge pressure reservoirs 65*a*, 65*b* and the inlet pressure zones 66*a*, 66*b*. The radial stroking results from the fluid passing to the undervane area 85 from overvane through the dual flow bores 82 in each vane assembly 36. This flow occurs when the vane assemblies 36 slide outward in the radial direction while passing through the pump inlet zone. As the vane assemblies 36 rotate and enter into the discharge zone, each vane assembly 36 is pushed inwards by the surface 35 of the cam ring 12 and, in turn, the corresponding volume is discharged under pressure into the discharge pressure reservoirs 65*a*, 65*b*, e.g., out of the pump assembly 10. In other words, the pump assembly 10 has two pumping effects: one is an intravane pumping or volume chamber pumping; and the other is undervane pumping.

It is to be appreciated that the subject disclosure includes many different advantageous feature, each of which may be interchanged in any combination on like pump assemblies. While the hydrostatically balanced variable displacement vane pump of the subject invention has been shown and described with reference to preferred embodiments, those skilled in the art will readily appreciate that various changes and/or modifications may be made thereto without departing from the spirit and scope of the subject invention as defined by the appended claims.

What is claimed is:

1. A vane pump assembly comprising:

a) a housing having opposing faces separated by a camming surface to define a pumping chamber, the housing defining at least one housing inlet for admitting fluid into the pumping chamber;

b) a rotor mounted for axial rotation within the pumping chamber, the rotor defining a flowpath in fluid communication with discharge pressure;

c) a plurality of vane assemblies coupled to the rotor to define a plurality of circumferentially spaced vane buckets for compressing the fluid, wherein each vane assembly has a front end and a rear end, each end having a seal assembly for reducing circumferential leakage between the vane buckets, wherein each vane assembly has a pathway in fluid communication with the flowpath to provide the discharge pressure to the seal assemblies for urging the seal assemblies axially outward; and d) front and rear side plates having rotor faces, wherein the seal assemblies seal against the respective rotor face.

2. A vane pump assembly as recited in claim 1, wherein the housing includes an annular spacer and the front and rear side plates are separated by the annular spacer to enclose the pumping chamber, the front and rear side plates defining diametrically opposed outlets for discharging fluid from the pumping chamber and a pocket in fluid communication with each diametrically opposed outlet, respectively, for providing the discharge pressure to the flowpath.

3. A vane pump assembly as recited in claim 2, further comprising a rotary cam ring in the pumping chamber and having an elliptical inner bore so that movement of the rotary cam ring varies displacement of the vane pump assembly.

4. A vane pump assembly as recited in claim 1, wherein the rotor defines a plurality of circumferentially spaced apart radially extending vane slots and each vane assembly is supported in a radially extending vane slot and the dynamic seal assembly includes a bumper further urged axially outward by at least one spring.

5. A vane pump assembly as recited in claim 1, further comprising floating front and rear rotor seals for reducing radially inward leakage, each rotor seal being disposed within a groove formed in each end of the rotor, wherein the front and rear rotor seals are urged axially outward by discharge pressure from the pumping chamber to create effective seals with the respective housing face.

6. A variable displacement vane pump assembly comprising:

a) a rotary cam ring having an outer circumferential surface and an elliptical inner bore defining a pumping chamber, the pumping chamber having a continuous interior camming surface, the rotary cam ring also defining at least one port for admitting fluid into the pumping chamber;

b) a rotor having a front and rear face and mounted for axial rotation within the elliptical inner bore of the rotary cam ring, the rotor defines a plurality of circumferentially spaced apart radially extending vane slots, an axial cavity, an annular groove centrally located about the axial cavity, and a plurality of radial bores in fluid communication with the annular groove and the vane slots, and a plurality of flowpaths extending from the annular groove to the front and rear face of the rotor;

c) a vane assembly supported in each radially extending vane slot to define a plurality of circumferentially spaced vane buckets, wherein each vane assembly is elongated and has a front end and a rear end, and further comprising a dynamic vane seal on each end of each vane assembly for reducing circumferential leakage between the vane buckets, each vane assembly defining a radial flow bore in fluid communication with a radial bore of the rotor and an outer vane channel in fluid communication with the radial flow bore;

d) an annular spacer surrounding the rotary cam ring and defining an interior bearing surface to accommodate selective rotation of the cam ring for varying the effective displacement of the pumping chamber, the annular spacer also defining at least one passage in fluid communication with the at least one port for admitting low pressure fluid into the pumping chamber; and e) front and rear side plates separated by the annular spacer and enclosing the pumping chamber, the front side plate defining at least one discharge port for discharging fluid from the pumping chamber and at least one discharge pressure pocket in fluid communication with the at least one discharge port, wherein the discharge pressure flows from the at least one discharge pressure pocket to the flowpaths and the annular groove to the radial bores of the rotor to the radial flow bore and an outer vane channel of the vane assemblies.

7. A pump assembly as recited in claim 6, wherein each dynamic vane seal has a bumper biased against the respective side plate by the discharge pressure and further comprising floating front and rear rotor seals for reducing radially inward leakage, each rotor seal being disposed within a groove formed in each end of the rotor, wherein the high pressure fluid urges the front and rear rotor seals axially outward from the pumping chamber to create an effective seal between the rotor seals and the respective plate.

8. A pump assembly as recited in claim 6, wherein the rotary cam ring defines at least one cam ring slot, and further comprising at least one screw to fix the annular spacer, the front side plate and the rear side plate with respect to the rotary cam ring, wherein the at least one screw passes through the at least one cam ring slot to act as a mechanical stop for movement of the rotary cam ring.

9. A pump assembly comprising:

a) a housing defining a hydraulic pumping chamber, the housing also defining at least one inlet for admitting fluid into the pumping chamber and at least one outlet for admitting fluid out of the pumping chamber;

b) a rotor mounted for axial rotation within the pumping chamber to energize the fluid;

c) floating front and rear rotor seals for reducing radially inward leakage, each rotor seal being disposed within a groove formed in each end of the rotor and having a sealing side and a rotor side, the rotor side being partially tapered, wherein discharge pressure fluid urges the front and rear rotor seals axially outward from the pumping chamber to create an effective seal between the rotor seals and the housing.

10. A pump assembly as recited in claim 9, wherein the floating rotor seals include at least one anti-rotation tab nestled in a respective hollow formed in the rotor, and the floating rotor seals have a sealing side and a rotor side, the rotor side defining a channel to effectively capture the discharge pressure fluid.

11. A hydrostatically balanced double-acting variable displacement vane pump assembly comprising:

a) a rotary cam ring having an outer circumferential surface and an elliptical inner bore defining a hydraulic pumping chamber, the pumping chamber having a continuous interior camming surface, the rotary cam ring also defining opposing ports for admitting low pressure fluid into the pumping chamber;

b) a rotor mounted for axial rotation within the inner bore of the rotary cam ring, the rotor having a front and rear face and defining: an axial cavity; an annular groove centrally located about the axial cavity; a plurality of circumferentially spaced apart radial bores in fluid communication with the annular groove; a plurality of angled bores extending from the annular groove to the front and rear face of the rotor; and a plurality of circumferentially spaced apart radially extending vane slots in fluid communication with the radial bores;

c) a vane assembly supported in each radially extending vane slot to define a plurality of circumferentially spaced vane buckets;

d) an undervane pin disposed within each radial bore;

e) an annular spacer surrounding the rotary cam ring and defining an interior bearing surface to accommodate selective rotation of the cam ring for varying the effective displacement of the pumping chamber, the annular spacer also defining opposing passages in fluid communication with the opposing ports for admitting low pressure fluid into the pumping chamber; and f) a front side plate having an inner and outer face, and defining: a central axial passage for a drive shaft; two diametrically opposed inlet ports for admitting low pressure fluid into the pumping chamber; two diametrically opposed discharge ports for discharging high pressure fluid from the pumping chamber; a flowpath adjacent each discharge port for providing discharge pressure to the angled bores; and opposing pockets to create inlet pressure zones in fluid communication with the vane slots; and g) a rear side plate having an inner and outer face, and defining: a central axial passage for a drive shaft; two diametrically opposed inlet ports for admitting low pressure fluid into the pumping chamber; two diametrically opposed discharge ports for discharging high pressure fluid from the pumping chamber; a flowpath adjacent each discharge port for providing discharge pressure to the angled bores; and opposing pockets to create inlet pressure zones in fluid communication with the vane slots, wherein: the front and rear side plates are separated by the annular spacer to enclose the pumping chamber; discharge pressure fills the flowpaths adjacent each discharge port, passes through the angled bores to the annular groove and into the radial bores of the rotor to act on the undervane pins to push the respective undervane pin and, in turn, the respective vane assembly radially outwardly against the camming surface of the cam ring; the discharge pressure also passes through the vane slots.

12. A vane pump assembly as recited in claim 11, further comprising axially floating annular face seals positioned between the rotor and the inner faces of the side plates, wherein the face seals and rotor are adapted and configured so that the face seals are pushed against the respective side plates by discharge pressure to reduce radial leakage.

13. A vane pump assembly as recited in claim 11, further comprising a cylindrical sleeve positioned within the axial cavity of the rotor to seal the annular groove in the rotor.

14. A vane pump assembly as recited in claim 11, wherein discharge pressure between the cylindrical sleeve and face seals forms a fluid bearing.

15. A vane pump assembly as recited in claim 11, wherein discharge pressure between the rotor and face seals forms a fluid bearing.

16. A vane pump assembly as recited in claim 11, wherein each vane assembly includes: a vane body with at least one radial bore.

17. A vane pump assembly as recited in claim 16, wherein the vane pump assembly also has a secondary radial stroking pumping effect utilizing the at least one radial bores.

18. A vane pump assembly as recited in claim 17, wherein the two inlet pressure opposing pockets are filled by fluid passing from the at least one radial bores to provide steady inlet pressure under the vane assemblies in an inlet zone, and the discharge flowpaths are used to provide steady discharge pressure under the vane assemblies in an outlet zone such that flow between the inlet pressure opposing pockets and the discharge flowpaths creates the secondary radial stroking pumping effect.

19. A vane pump assembly as recited in claim 18, wherein the secondary radial stroking pumping effect results from fluid passing to the under the vane assemblies from overvane through the at least one radial bore in each vane assembly in the inlet zone and as the vane assemblies rotate and enter into the discharge zone, each vane assembly is pushed inwards by the rotary cam ring and, in turn, a corresponding volume is discharged under pressure into the discharge flowpaths.

20. A vane pump assembly as recited in claim 19, wherein each vane assembly further includes; dual radially outer vane tips on the vane body; and front and rear outwardly biased dynamic face seals acting against the front and rear side plates, respectively.

21. A pump assembly comprising:

a) a housing defining a hydraulic pumping chamber, the housing also defining at least one inlet for admitting fluid into the pumping chamber and at least one outlet for admitting fluid out of the pumping chamber;

b) a rotor mounted for axial rotation within the pumping chamber to energize the fluid;

c) floating front and rear rotor seals for reducing radially inward leakage, each rotor seal being disposed within a groove formed in each end of the rotor and having a sealing side and a rotor side, the rotor side defining a channel to effectively capture discharge pressure fluid for urging the front and rear rotor seals axially outward from the pumping chamber to create an effective seal between the rotor seals and the housing.

22. A variable displacement vane pump assembly comprising:

a) a rotary cam ring having an outer circumferential surface and an inner bore defining a pumping chamber, the pumping chamber having a continuous interior camming surface, the rotary cam ring also defining at least one port for admitting fluid into the pumping chamber and at least one cam ring slot;

b) a rotor mounted for axial rotation within the inner bore of the rotary cam ring, the rotor defines a plurality of circumferentially spaced apart radially extending vane slots;

c) a vane assembly supported in each radially extending vane slot to define a plurality of circumferentially spaced vane buckets;

d) an annular spacer surrounding the rotary cam ring and defining an interior bearing surface to accommodate selective rotation of the cam ring for varying the effective displacement of the pumping chamber, the annular spacer also defining at least one passage in fluid communication with the at least one port for admitting low pressure fluid into the pumping chamber;

e) front and rear side plates separated by the annular spacer and enclosing the pumping chamber, the front side plate defining at least one discharge port for discharging fluid from the pumping chamber; and f) at least one screw to fix the annular spacer, the front side plate and the rear side plate with respect to the rotary cam ring, wherein the at least one screw passes through the at least one cam ring slot to act as a mechanical stop for movement of the rotary cam ring.

* * * * *